US006132196A

United States Patent [19]

Harrison

[11] Patent Number: 6,132,196

[45] Date of Patent: Oct. 17, 2000

[54] FLUID VANE MOTOR/PUMP

[76] Inventor: Leslie Mervyn Harrison, 32 Cooper Road, Morley, W.A. 6062, Australia

[21] Appl. No.: 09/194,405

[22] PCT Filed: May 28, 1996

[86] PCT No.: PCT/AU96/00326

§ 371 Date: Jul. 21, 1999

§ 102(e) Date: Jul. 21, 1999

[87] PCT Pub. No.: WO96/38654

PCT Pub. Date: Dec. 5, 1996

[51] Int. Cl.[7] ..... F01C 19/00

[52] U.S. Cl. ..... 418/143; 418/258; 418/259; 418/269

[58] Field of Search ..... 418/143, 258, 418/259, 269

[56] References Cited

U.S. PATENT DOCUMENTS

| | | | |
|---|---|---|---|
| 3,995,976 | 12/1976 | Ishizuka . | |
| 4,268,230 | 5/1981 | Bassan | 418/15 |
| 4,331,420 | 5/1982 | Jones | 418/32 |
| 4,445,830 | 5/1984 | Woodruff | 418/22 |
| 4,484,873 | 11/1984 | Inagaki et al. . | |
| 5,964,584 | 10/1999 | Lorentz | 418/73 |

FOREIGN PATENT DOCUMENTS

| | | |
|---|---|---|
| 102792 | 1/1938 | Australia . |
| 7389/52 | 3/1952 | Australia . |
| 57552/90 | 10/1990 | Australia . |
| 0 230 054 A1 | 7/1987 | European Pat. Off. . |
| 2469581 | 5/1981 | France . |
| 27 20 910 | 11/1978 | Germany . |
| 35 12 676 A1 | 10/1986 | Germany . |
| 195 39 136 A1 | 4/1996 | Germany . |
| 1 350 858 | 4/1974 | United Kingdom . |
| 2248651 | 4/1992 | United Kingdom . |
| 2248655 | 4/1992 | United Kingdom . |

*Primary Examiner*—Thomas Benion
*Assistant Examiner*—Theresa Trieu
*Attorney, Agent, or Firm*—Kevin C. Brown

[57] ABSTRACT

A motor/pump (10) comprises a housing (12) defining a cavity (18) between sealed ends (14 and 16). Rotor (24) having a substantially hollow body (26) is supported by the housing (12) for rotation within the cavity (18) about a rotation axis (28) which is parallel to but offset from longitudinal axis (30) of the cavity (18). A plurality of vanes (32) are retained by the rotor (34) for movement radially of the rotation axis (28). ne vanes (32), rotor (24) and housing (12) are juxtaposed so that a substantially sealed chamber is formed between adjacent vanes (32), inner surface (34) of housing (12) and outer circumferential surface (36) of the rotor body (26). First and second ports (20, 22) are formed in the housing (12) and located so as to be disposed in different chambers. A split sleeve (122) is disposed within the rotor (24) for biasing the vanes (32) radially outwardly from the rotation axis (28) wherein axially opposite ends of said vanes (32) are disposed inboard of opposite first and second ends of said rotor body so that in use only a length of said axially opposite ends of each vane which extend beyond an outer peripheral surface (36) of said rotor body can slidingly contact respective adjacent ends of said housing (46, 56).

16 Claims, 6 Drawing Sheets

FLUID VANE MOTOR/PUMP

FIELD OF THE INVENTION

The present invention relates to an apparatus capable for use as a pump or motor, and in particular, to a fluid Vane pump/motor.

BACKGROUND OF THE INVENTION

Typically, fluid vane motors comprise a housing having a cylindrical bore closed by end plates and a rotor mounted for rotation within the bore. The rotor is in the form of a solid cylindrical billet of metal with longitudinally extending slots formed about its periphery. The axis of rotation of the rotor is parallel to but offset from the longitudinal axis of the housing. A plurality of vanes are supported in respective longitudinal slots in the rotor in a manner so as to allow movement in the radial direction. Fluid chambers are formed between adjacent vanes, the volume of the chambers varying as the rotor rotates. When functioning as a pump, the chambers act to displace fluid from an inlet in the housing to an outlet, and when acting as a motor, the chambers allow for the release of pressure of a pressurised fluid to cause rotation of a shaft attached to the rotor.

Conventional fluid vane motors/pumps are notoriously inefficient due to leakage of fluid between adjacent chambers via leakage paths formed about the periphery of the vanes as well as through the rotor itself. Additionally, high frictional losses occur due to the substantial contact area between the peripheral edges of the vanes and end plates of the housing.

SUMMARY OF THE INVENTION

It is an object of the present invention to provide an apparatus capable for use as a pump or motor of increased efficiency.

According to the present invention there is provided an apparatus capable for use as a pump or motor, said apparatus comprising:

- a housing having sealed ends and provided with a cavity between said ends, said housing further including first and second ports both allowing fluid communication between the interior and exterior of said housing;
- a rotor having a substantially hollow rotor body supported by said housing for rotation within said cavity about a rotation axis extending parallel to and offset from a longitudinal axis of said cavity, said rotor body having opposite first and second ends which include respective portions of reduced diameter with respect to an intermediate portion of said rotor body;
- a plurality of slots formed in said rotor body extending between said opposite first and second ends and terminating in and inboard of said reduced diameter portions; and,
- a plurality of vanes, individual ones of which are slidably retained in separate slots for movement radially of said rotation axis;
- said vanes, rotor and housing juxtaposed so that a substantially sealed chamber is formed between adjacent vanes, an inner circumferential surface of said housing and said rotor, and wherein said first and second ports are disposed in different ones of said chambers.

Preferably said opposite ends of each slot are arcuate in shape.

Preferably there is provided a seal about each of said reduced diameter portions, said seals being seated so as to cover the opposite ends of each slot and sealing abut axially opposite ends of said vanes.

Preferably each end of said housing is provided with a stepped inner surface formed by the junction of two faces and each seal can make sealing contact with both of said faces of an adjacent end of said housing.

Preferably a groove extending radially from each end of each slot is formed on a surface at each of said first and second ends interior of said rotor body for receiving axially opposite ends of a vane received in that slot.

Preferably said grooves on said interior surface at said first end of said rotor body extend beyond the centre of said rotor body.

In an alternate embodiment said interior surface at said first end of said rotor body is provided with a circular recess centered about said rotation axis and the grooves formed on this interior surface extends radially from the end of the slots near said first end to said circular recess.

Preferably said rotor comprises a shaft extending from the first end of said rotor body and through an aperture formed in a first of said ends of said housing, wherein when said apparatus is used as a pump, torque can be applied to said shaft to impart rotational motion to said rotor, and when said apparatus is used as a motor, said shaft can act as a power take off.

Preferably the second end of said rotor body opposite said shaft is provided with a recess for receiving a stub shaft formed on a second of said ends of said housing for rotatably supporting said second end of said rotor body.

Preferably said axially opposite edges of said vanes are formed with arcuate surfaces for sliding and substantially sealing contact with respective adjacent first and second ends of said housing.

Preferably the radially remote edge of each vane is formed with an arcuate surface for sliding and substantially sealing contact with said inner circumferential surface of said housing.

Preferably said apparatus further comprises biasing means disposed within said rotor body for biasing said vanes radially outwardly towards said inner circumferential surface of said housing.

Preferably a recess is formed in the radially inner edge of each vane inboard of axially opposite ends of each vane for receiving said biasing means.

Preferably said rotor comprises a shaft extending from the first end of said rotor body and through an aperture formed in a first of said ends of said housing, wherein when said apparatus is used as a pump, torque can be applied to said shaft to impart rotational motion to said rotor, and when said apparatus is used as a motor, said shaft can act as a power take off.

Preferably said resilient element comprises one of a split sleeve or a tube of resilient material; a length of natural or synthetic rubber tubing or rod; a tube or rod made of plastics material; a flat section helical-spring fitted axially within said rotor body; a solid or hollow rod or tube of material provided with resilient circumferentially spaced inserts at intervals corresponding to the location of said vanes. In an alternate embodiment, said biasing means comprises a pressurised fluid retained within said rotor body.

BRIEF DESCRIPTION OF THE DRAWINGS

An embodiment of the present invention will now be described by way of example only, with reference to the accompanying drawings in which.

DETAILED DESCRIPTION OF THE PREFERRED EMBODIMENTS

Figure 1:
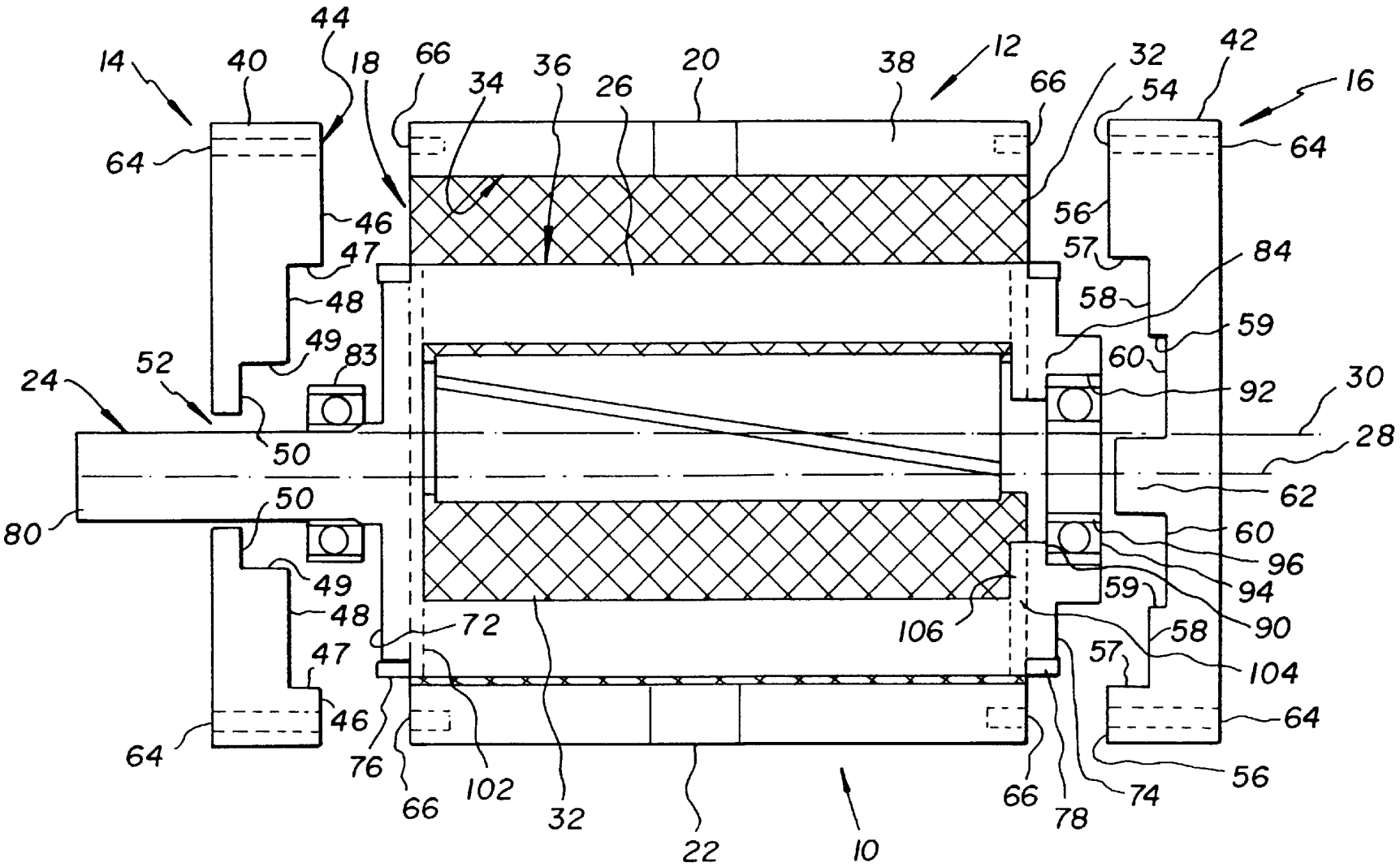
FIG. 1 is an axial section and partly exploded view of an embodiment of an apparatus according to the present invention.

Referring to FIG. 1, it can be seen that an apparatus 10 capable for use as a pump or motor comprises a housing 12 having sealed ends 14 and 16 and provided with a cavity 18 between said ends 14 and 16. First and second ports 20 and 22 are also formed in the housing 12 for allowing fluid communication between the interior and exterior of the housing 12. Rotor 24 having a substantially hollow body 26 is supported by the housing 12 for rotation within the cavity 18 about a rotation axis 28 which is parallel to but offset from longitudinal axis 30 of the cavity 18. A plurality of vanes 32 are retained by the rotor 24 for movement radially of the rotation axis 28. The vanes 32, rotor 24 and housing 12 are juxtaposed sb that a substantially sealed chamber is formed between adjacent vanes 32, inner surface 34 of the housing 12 and outer circumferential surface 36 of the rotor body 26. The first and second ports 20 and 22 are disposed in different chambers.

The housing 12 is composed of a cylindrical member 38, the interior of which forms cavity 18. Ends 14 and 16 of the housing 12 are in the form of plates 40 and 42 respectively which can be bolted to opposite ends of the cylindrical element 38. As is apparent from FIG. 1, the surface of each of the plates 40 and 42 facing the rotor 24 is stepped In the case of first plate 40, the interior surface 44 is stepped so as to reduce in width in the radial direction toward rotation axis 28. More particularly, surface 44 comprises a first annular-like radially outer-most surface 46, a stepped surface 47, an adjacent second radially inner intermediate annular-like surface 48, a further stepped surface 49, and adjacent and radially innermost third annular-like third surface 50. An aperture or hole 52 is formed through the first plate 40 centred on rotation axis 28.

The second plate 42 has an inner surface 54 which is composed of a first radially outermost annular-like surface 56, first stepped surface 57, an adjacent and radially inner annular-like second surface 58, second stepped surface 59, and. a radially innermost annular-like third surface 60. Extending from the third surface 60 concentrically with rotation axis 28 is stub shaft 62. A plurality of axially extending holes 64 are formed circumferentially about the first and second plates 40 and 42 which are disposed to register with threaded holes 66 formed in the opposite ends of the cylindrical element 38. Bolts (not shown) are passed through holes 64 and threadingly engage holes 66 for fastening the first and second plates 40 and 42 to opposite ends of the cylindrical element 38.

Figure 3:
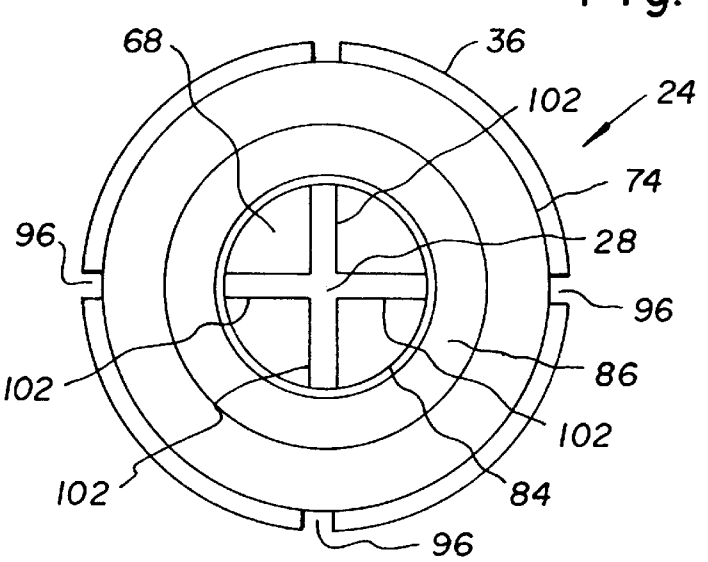
FIG. 3 is an end elevation of an opposite end of the rotor shown in FIG. 2.
Figure 2:
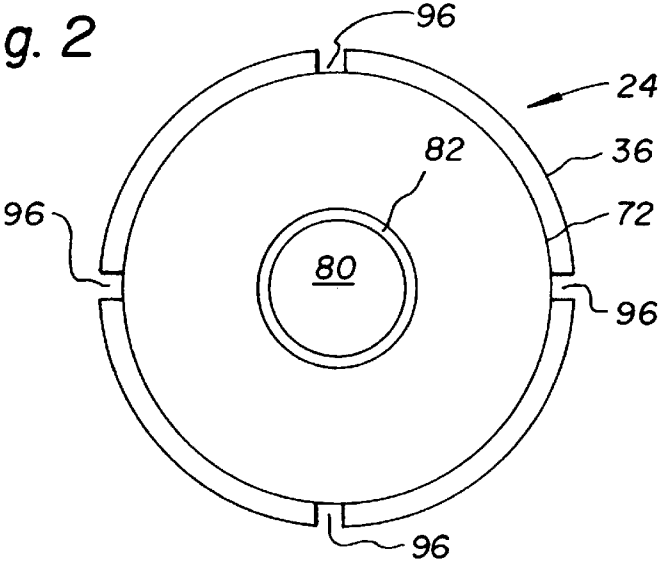
FIG. 2 is an end elevation view of one end of a rotor incorporated in the apparatus shown in FIG. 1.
Figure 4:
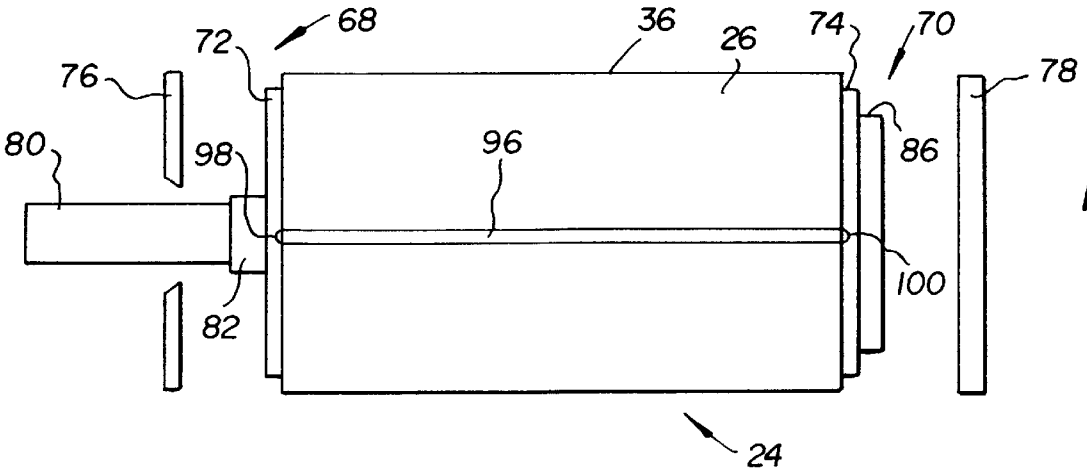
FIG. 4 is a side elevation of the rotor shown in FIGS. 1 and 2.
Figure 5C:
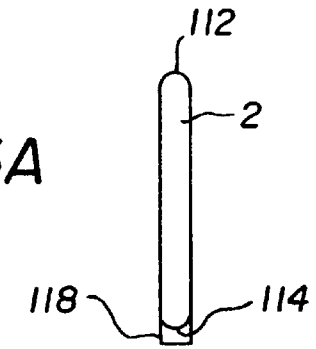
FIG. 5C is a view of Section A—A of the vane shown in FIG. 5A.

As seen in FIGS. 2 to 4, rotor body 26 is in the general form of a hollow cylinder being closed at a first end 68 and open at an opposite second end 70. The rotor body 26 is provided with reduced diameter portions 72 and 74 at the first and second ends 60 and 70 respectively. As seen most clearly in FIG. 1, the reduced diameter portions 72 and 74 seat annular seals 76 and 78 respectively. Shaft 80 extends from the first end 68 concentric with rotation axis 28 through the hole 52 in the first plate 40. A short length 82 of the shaft 80 adjacent the first end 68 is formed of an increased diameter. Bearing 83 is fitted onto shaft 80 up to short length 82 and is sealed against surfaces 49 and 50 of the first plate 40.

Second end 70 is formed with a radially inwardly extending circumferential lip 84 and an axially extending annular boss 86. Stub shaft 62 can be received in the opening formed by the lip 84 and boss 86. The juxtaposition of annular surface 90 of the lip 84 facing a second plate 42 and the radially innermost circumferential surface 92 of the boss 86 form a sear for bearing 94. The bearing 94 has an inner race 96 which receives, with an interference fit, the stub shaft 62.

A plurality of slots 96 (refer FIGS. 2 to 4) are formed in the rotor body 26 which extend between and inboard of the first end 68 and second end 70. As seen most clearly in FIG. 4, opposite ends 98 and 100 of the slots 96 are arcuate in shape and terminate on the reduced diameter portions 72 and 74 respectively. Slots 96 pass wholly through the thickness of the rotor body 26. In this particular embodiment, four equally spaced slots 96 are formed circumferentially about the rotor body 26. A radially extending groove 102 (refer FIGS. 1 and 3) is formed on an interior surface of first end 68 extending co-linearly with the depth of each slot 96 at end 98. Each groove 102 extends to the rotational axis 28 and runs into a corresponding groove 102 of an opposing slot 96.

Grooves 104 of similar configuration to grooves 102 are formed at the opposite end 100 of each slot 96 on an axially inner annular surface 106 of the lip 84. However, as the grooves 104 only extend for the axial length of lip 84, they do not pass through the rotational axis 28 nor do grooves 104 of opposing slots 96 run into each other. Vanes 32 are in the form of generally rectangular plates having arcuate, and more particularly convexly curved axial edges 108 and 110 and similarly curved radially remote edge 112 and radially near edge 114. The axial edges 108 and 110 extend in a radial direction below the radially near edge 104 so as to form protruding tabs 116 and 118 respectively between which a recess 120 is defined.

Figure 6B:
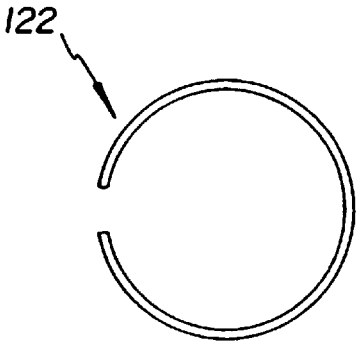
FIG. 6B is an end elevation of the biasing element shown in FIG. 6A.
Figure 5A:
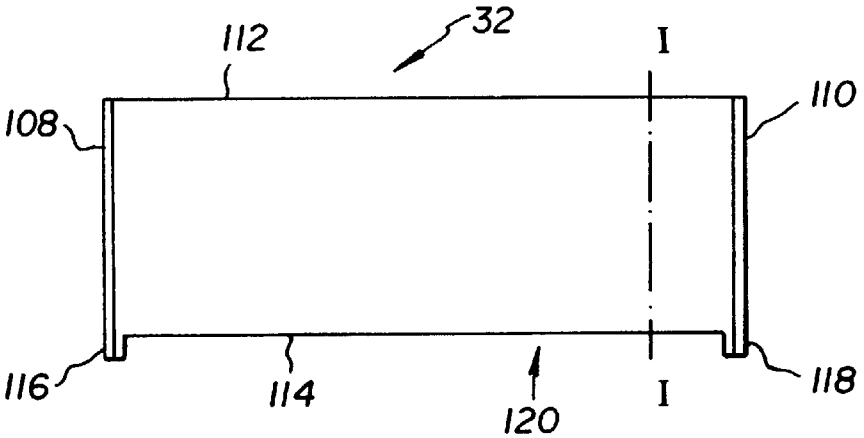
FIG. 5A is a side elevation of a vane incorporated in the apparatus shown in FIG. 1.
Figure 5B:
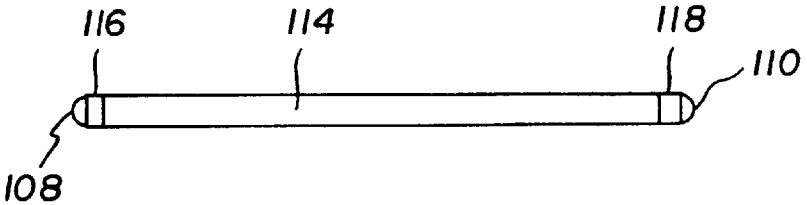
FIG. 5B is a bottom elevation of the vane shown in FIG. 5A.
Figure 6A:
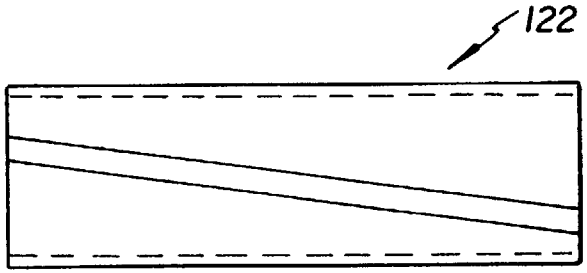
FIG. 6A is a side elevation of a biasing element incorporated in the apparatus shown in FIG. 1.

A biasing means in the form of a split sleeve 122 (refer FIGS. 1, 6A and 6B) is disposed within the cylindrical element 38 for biasing the vanes 32 radially outwardly from rotation axis 28 so that radially remote edge 112 of the vanes 32 are in sliding and sealing contact with inner surface 34 with at most a layer of lubricant therebetween. The split sleeve 122 is received in the recess 120 between tabs 116 and 118 of each vane 32 preventing axial movement of the sleeve 122 during operation of the apparatus 10. The sleeve 122 is made of a spring metal and dimensioned so as to maintain contact with all of the vanes 32 during rotation of the rotor 24. It will be appreciated that the sleeve 122 floats within the rotor 24 and adopts a position that is concentric with and parallel to axis 30 of the housing 12. Generally, the outside diameter of the sleeve 122 is equal to the internal diameter of housing 12 minus twice the distance between the radially remote and near edges 112 and 114 of a vane 32. However, in the specific case of the present split sleeve the outside diameter is fractionally larger to provide a degree of spring loading the radially near edges 114 of the vanes 32.

When the apparatus 10 is fully assembled, the seal 76 overlies end 98 of each slot 96 and abuts axial edge 108 of each vane 32. Seal 78 is similarly juxtaposed relative to the end 100 of slots 96 and axial edge 110 of vanes 32. As a result, the seals 76 and 78 effectively seal the ends of slots 96. Further, seal 76 sealingly abuts surfaces 47 and 48 of first plate 40. Likewise, seal 78 sealingly abuts surfaces 57 and 58 of the second plate 42 Radially remote edge 112 of each vane 32 forms a sliding seal against inner surface 34 of housing 12.

The curvature on the radially remote and radially near edges 112 and 114 of the vanes 32 are shaped to suit the curvature of the inner surface 34 of housing 12 and the curvature and location of the outer peripheral surface of sleeve 122 respectively. The vanes 32 are of a length equal to that of cylindrical element 38 of the housing less a lubricating tolerance, similarly the width of the slots 96 and thickness of vanes 32 are relatively dimensioned so as to allow sliding of the vanes 32 within the slots 96 with a lubricating tolerance therebetween. By forming these components of the apparatus 10 with such a close tolerance together with the inclusion of seals 76 and 78 fluid leakage within the apparatus 10 is minimised.

Figure 7:
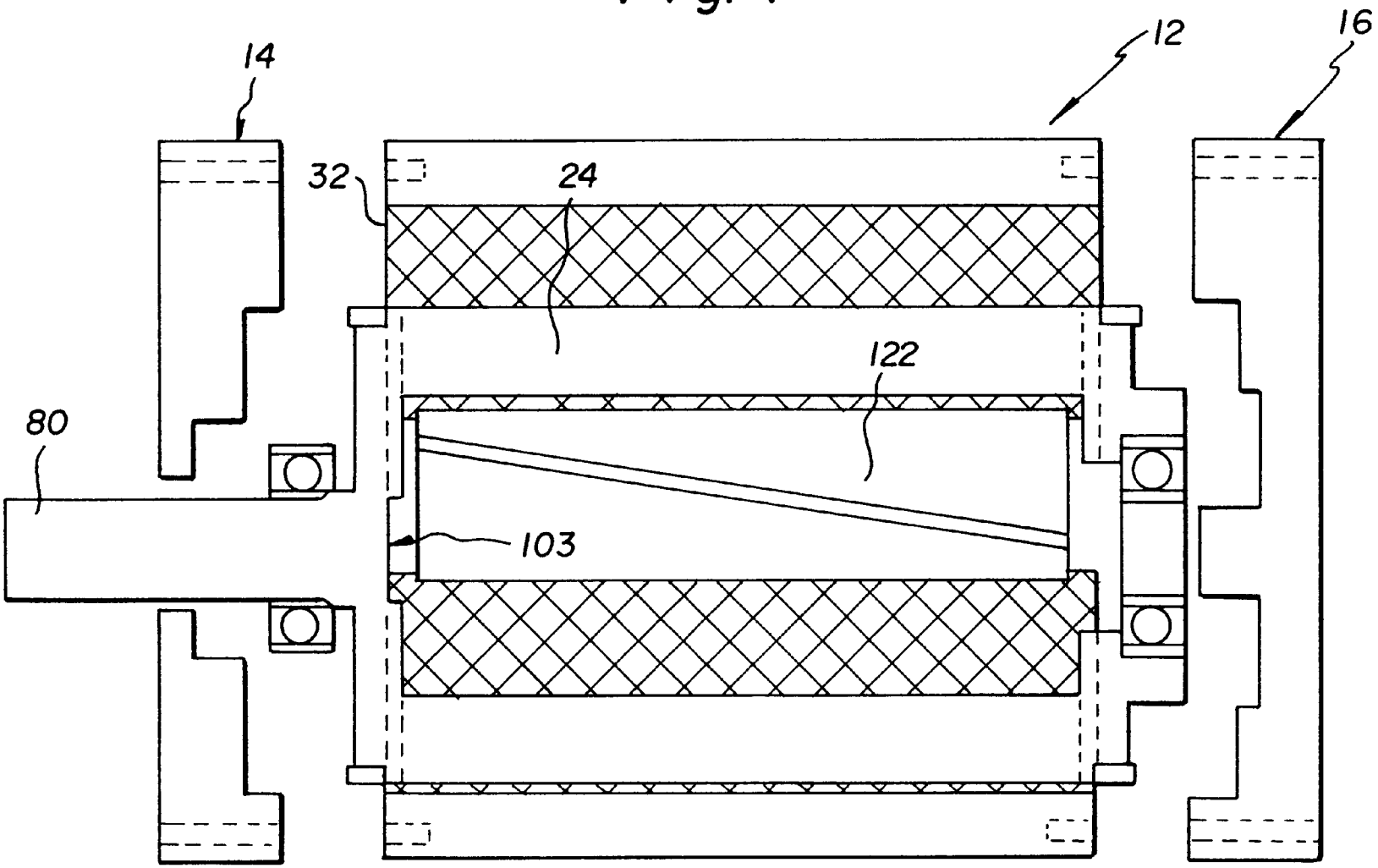
FIG. 7 is an axial section and partly exploded view of a second embodiment of the apparatus.
Figure 8:
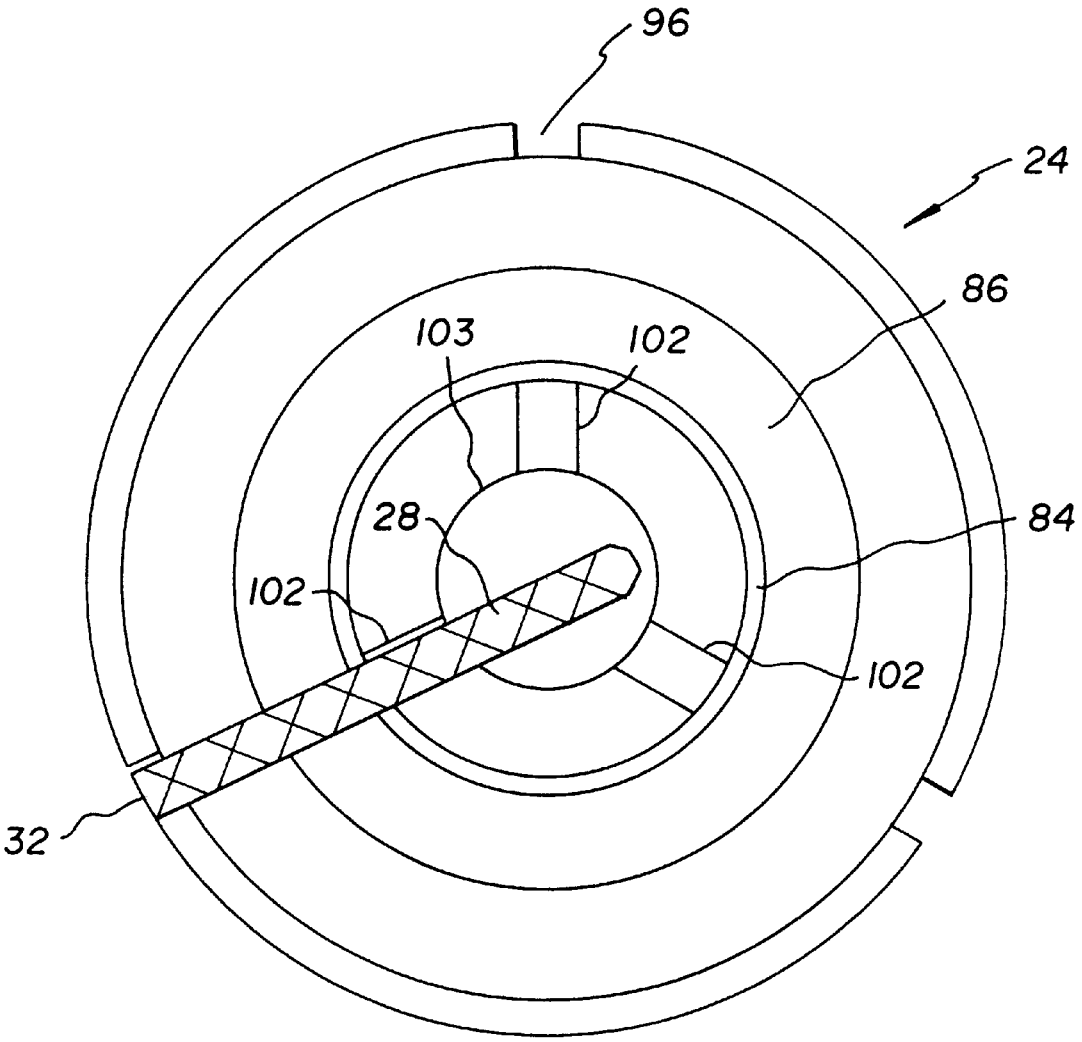
FIG. 8 is an end elevation of an end of the rotor shown in FIG. 7.

An embodiment of the apparatus 10 with three vanes is -illustrated in FIGS. 7 and 8. In these Figures like numbers indicate the same features as described with reference to the embodiment shown in FIGS. 1 to 6B.

It will be appreciated that when the apparatus 10 comprises three (or any other odd number) of vanes 32 there will not be pairs of diametrically opposed grooves 102, which in the case of an apparatus 10 with an even number of vanes 32, allows retraction of the vanes 32 within the rotor beyond the central axis 28. In order to allow for such over center retraction of vanes 32 in the present embodiment the interior surface of first end 68 is counter bored about axis 28 to form a circular recess 103 of a depth equal to the depth of grooves 102.

Figure 9A:
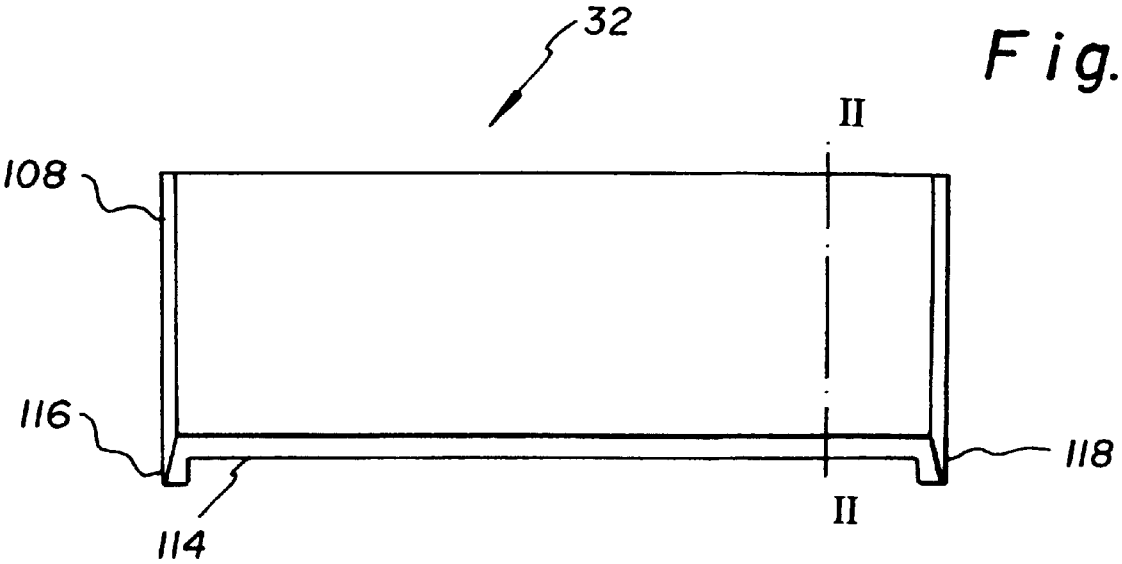
FIG. 9A is a side elevation of a second embodiment of a vane used in the present apparatus.
Figure 9C:
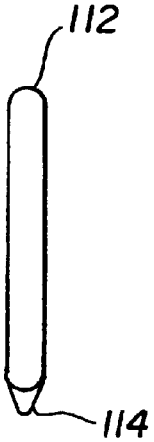
FIG. 9C is a view of Section A—A of the vane shown in FIG. 9A.
Figure 9B:
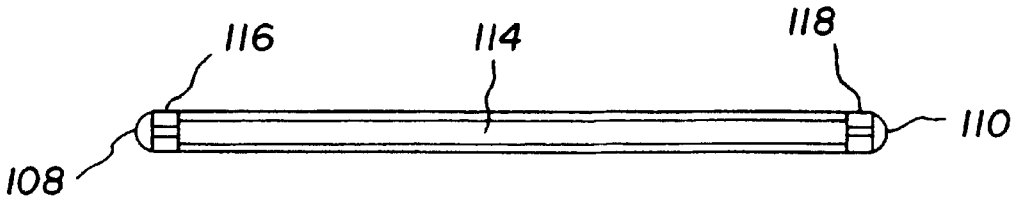
FIG. 9B is a bottom view of the vane shown in FIG. 9A.

In a further possible embodiment, the design of the vanes 32 can be modified so that the radially inner edge 114 is tapered on both sides as shown in FIGS. 9A to 9C. The tapering is not necessary in the case of the rotor 24 supporting six or less vanes 32. However, it is particularly advantageous for preventing interference between the radially inner edge 114 of adjacent vanes 32 in the case of a rotor having seven or more vanes when adjacent vanes are at or nearing full retraction and extend over the axis 28.

From the foregoing description, it will be apparent to those skilled in the art that the above embodiments include numerous advantages and benefits over prior known radial vane motors and pumps including:

(a) The hollow rotor offers a considerable weight reduction when compared with the conventional solid slotted rotor.

(b) A smaller diameter rotor can be employed with a greater degree of eccentricity within a housing of a given internal diameter, resulting in an increase in effective vane extension with an attendant increase in volumetric capacity.

(c) A greater number of vanes can be employed in the hollow rotor with a larger effective vane extension from the rotor than can be achieved with the conventional slotted rotor, due to the fact that the grooves 102 of the hollow rotor intersect at the rotor axis 28 (see FIG. 3). It follows that if the slots in a conventional rotor were to intersect at the rotor axis, there would remain no segmental web at the root of the slots and the rotor could not exist in this form. Conversely, because the segmental web of the hollow rotor is at its outside diameter, the intersection of the grooves at the rotor axis does not affect the integrity of the rotor. Therefore the hollow rotor motor has the potential to deliver more power with less torque variation than the conventional unit having the same external dimensions, and as a pump, provide a greater fluid delivery with lower pulse amplitude than a conventional unit having the same external dimensions.

(d) The sleeve 122 supporting nearly the total length of the vanes 32 ensures the proper vane 32 to housing sealing contact, preventing partial retraction of the vanes when subjected to high operating pressures as is the case with reliance being on fluid pressure for vane extension, and preventing bowing of vanes under high fluid pressure when such vanes are only supported at their ends by cams or rings etc. The prevention of fluid by-pass between the vanes 32 and inner surface 34 of housing 12 will result in improved efficiency of the device.

(e) In conventional radial sliding vane pumps and motors flat axial ends of the vanes are in constant contact with the surfaces of the end plates regardless of whether they are retracted or extended relative to the rotor, which is a cause of significant lateral frictional drag. In the described embodiment, because the end plates 40, 42 are recessed to the outside diameter of the rotor body 26, the vanes 32 can only contact the end plates 40, 42 when they are extended beyond the outer circumferential surface 36 of the rotor body 26, therefore the frictional drag attributable to the axial vane ends 108, 110 is considerably reduced by limiting their contact to approximately 50% of the end plate working areas. This frictional drag is further reduced by the smaller contact area of the radiused axial vane ends 108, 110 as opposed to that generated by full thickness flat vane ends. This feature also precludes the possibility of the rotor ends contacting the end plates as is common in conventional sliding vane units.

(f) Correctly toleranced seals 76, 78 prevent internal by-pass of operating fluid between adjacent or other chambers either around the axial vane ends 108, 110 or via the unoccupied sections of the slots 96 due to their common access to the operating fluid as is usual in conventional sliding vane type pumps or motors. This feature also limits fluid loss or internal by-pass when the unit is in the stalled condition under operating load conditions.

Now that an embodiment of the invention has been described in detail, it will be apparent to those skilled in the relevant arts that numerous modifications and variations may be made without departing from the basic inventive concepts. For example, although the housing 12 is shown as including separate end plates 40 and 42, one of those ends may be formed integrally with the cylindrical element 38 of the housing 12 and machined to provide the relevant step surfaces. Also, while the rotor 24 is shown as being a four vane (ie. four slot 96) greater or fewer vanes can be incorporated. In addition, the biasing element for biasing the vanes 32 radially outwardly is shown as being a split sleeve 122. However, other types of biasing elements can be used to achieve the same effect for example; a length of resilient tubing or rod such as may be made from natural or synthetic rubber, or plastics material; a flat section helical spring; a solid or hollow rod or tube of material provided with resilient circumferentially spaced inserts at intervals corresponding to the location of the vanes 32; of a pressurised fluid sealed within the rotor body. All such modifications and variations are deemed to be within the scope of the present invention, the nature of which is to be determined from the foregoing description.

What is claimed is:

1. An apparatus capable for use as a pump or motor, said apparatus comprising:

a housing having sealed ends and provided with a cavity between said ends, said housing further including first and second ports both allowing fluid communication between the interior and exterior of said housing;

a rotor having a substantially hollow rotor body supported by said housing for rotation within said cavity about a rotation axis extending parallel to and offset from a longitudinal axis of said cavity, said rotor body having opposite first and second ends which include respective portions of reduced diameter with respect to an intermediate portion of said rotor body;

a plurality of slots formed in said rotor body extending between said opposite first and second ends and terminating in and inboard of said reduced diameter portions; and, a plurality of vanes, individual ones of which are slidably retained in separate slots for movement radially of said rotation axis;

said vanes, rotor and housing juxtaposed so that a substantially sealed chamber is formed between adjacent vanes, an inner circumferential surface of said housing and said rotor, and wherein said first and second ports are disposed in different ones of said chambers.

2. An apparatus according to claim 1, further comprising a seal about each of said reduced diameter portions, said seals being seated so as to cover the opposite ends of each slot and sealing abut axially opposite ends of said vanes.

3. An apparatus according to claim 2, wherein said opposite ends of each slot are arcuate in shape.

4. An apparatus according to claim 3, wherein each end of said housing is provided with a stepped inner surface formed by the junction of two faces and each seal can make sealing contact with both of said faces of an adjacent end of said housing.

5. An apparatus according to claim 4, wherein a groove extending radially from each end of each slot is formed on a surface at each of said first and second ends interior of said rotor body for receiving axially opposite ends of a vane received in that slot.

6. An apparatus according to claim 5, wherein said grooves on said interior surface at said first end of said rotor body extend beyond the centre of said rotor body.

7. An apparatus according to claim 5, wherein said interior surface at said first end of said rotor body is provided with a circular recess centered about said rotation axis and the grooves formed on this interior surface extends radially from the end of the slots near said first end to said circular recess.

8. An apparatus according to claim 1, wherein axially opposite edges of said vanes are formed with arcuate surfaces for sliding and substantially sealing contact with respective adjacent first and second ends of said housing.

9. An apparatus according to claim 1, wherein the radially remote edge of each vane is formed with an arcuate surface for sliding and substantially scaling contact with said inner circumferential surface of said housing.

10. An apparatus according to claim 1, further comprising biasing means disposed within said rotor body for biasing said vanes radially outwardly cowards said inner circumferential surface of said housing.

11. An apparatus according to claim 10, wherein said biasing means comprises a resilient element extending in the direction of said rotation axis and adapted to act simultaneously on each of said vanes.

12. An apparatus according to claim 11, wherein said resilient element comprises one of a split sleeve or a tube of resilient material; a length of natural or synthetic rubber tubing or rod; a tube or rod made of plastics material; a flat section helical spring fitted axially within said rotor body; a solid or hollow rod or tube of material provided with resilient circumferentially spaced inserts at intervals corresponding to the location of said vanes.

13. An apparatus according to claim 12, wherein a recess is formed in the radially inner edge of each vane inboard of axially opposite ends of each vane for receiving said biasing means.

14. An apparatus according to claim 10, wherein said biasing means comprises a pressurised fluid retained within said rotor body.

15. An apparatus according to claim 1, wherein said rotor comprises a shaft extending from the first end of said rotor body and through an aperture formed in a first of said ends of said housing, wherein when said apparatus is used as a pump, torque can be applied to said shaft to impart rotational motion to said rotor, and when said apparatus is used as a motor, said shaft can act as a power take off.

16. An apparatus according to claim 15, wherein the second end of said rotor body opposite said shaft is provided with a recess for receiving a stub shaft formed on a second of said ends of said housing for rotatably supporting said second end of said rotor body.

* * * * *